US005922407A

United States Patent [19]

Hess et al.

[11] Patent Number: 5,922,407

[45] Date of Patent: Jul. 13, 1999

[54] METHOD AND AN APPARATUS FOR THE APPLICATION OF A LIQUID OR PASTY MEDIUM ONTO A MOVING MATERIAL WEB

[75] Inventors: Harald Hess, Grünkraut; Joachim Henssler, Ravensburg; Michael Trefz, Heidenheim; Bernhard Kohl, Heidenheim; Zygmunt Madrzak, Heidenheim; Rudolf Münch, Königsbronn/Zang, all of Germany

[73] Assignee: Voith Sulzer Papiermaschinen GmbH, Heidenheim, Germany

[21] Appl. No.: 08/918,929

[22] Filed: Aug. 25, 1997

[30] Foreign Application Priority Data

Aug. 26, 1996 [DE] Germany ..... 196 34 448
Jul. 25, 1997 [DE] Germany ..... 197 32 138

[51] Int. Cl.[6] ..... B05D 3/12

[52] U.S. Cl. ..... 427/348; 427/335; 427/389.9; 427/391; 427/424; 118/305

[58] Field of Search ..... 427/348, 424, 427/389.9, 391, 335; 118/305

[56] References Cited

U.S. PATENT DOCUMENTS

| | | | |
|---|---|---|---|
| 4,282,998 | 8/1981 | Peekna | 226/97 |
| 4,548,837 | 10/1985 | Yoshino et al. | 427/209 |
| 5,136,966 | 8/1992 | Miyagawa et al. | 118/58 |
| 5,199,623 | 4/1993 | Rajala et al. | 226/97 |
| 5,230,165 | 7/1993 | Beisswanger | 34/60 |
| 5,639,303 | 6/1997 | Plomer | 118/218 |

FOREIGN PATENT DOCUMENTS

| | | |
|---|---|---|
| 31 14 056 C2 | 4/1981 | Germany . |
| 85 32 371 U | 2/1986 | Germany . |
| 40 03 956 A1 | 2/1990 | Germany . |
| 40 29 487 A1 | 9/1990 | Germany . |
| 44 15 581 A1 U | 1/1995 | Germany . |
| 0 711 723 A2 | 10/1995 | Germany . |
| 44 16 399 A1 | 11/1995 | Germany . |
| 44 29 964 A1 | 2/1996 | Germany . |
| WO 95 30 795 A1 | 4/1995 | WIPO . |

OTHER PUBLICATIONS

"Lueger Lexikon der Technik", Alfred Ehrhardt and Hermann Franke, vol. 2, pp. 522, 523, (no date).

*Primary Examiner*—Janyce Bell
*Attorney, Agent, or Firm*—Taylor & Associates, P.C.

[57] ABSTRACT

A method of application of a liquid or pasty medium onto a moving material web consisting, in particular, of paper or cardboard, in which a direct application (2) of a liquid or pasty medium (4) onto one side of a moving material web (1) and a contactless deflection (3) of the moving material web along a curved path of motion ensues, the side of the moving material web to be provided with the liquid or pasty medium passing through a concave curvature and the direct application (2) of the liquid or pasty medium ensuing directly ahead of the deflection (3) or during the deflection as a free jet along a contactlessly guided section of the moving material web. Additionally, an apparatus for implementing the method is described.

32 Claims, 6 Drawing Sheets

METHOD AND AN APPARATUS FOR THE APPLICATION OF A LIQUID OR PASTY MEDIUM ONTO A MOVING MATERIAL WEB

BACKGROUND OF THE INVENTION

The invention relates to a method of application of a liquid or pasty medium onto a moving material web and to an apparatus for implementing the method.

A method as well as an apparatus of this type are known from DE 44 15 581 C2. A coating medium is directly or indirectly applied by an application means onto a moving material web. After passing the application unit, the material web is initially moved along a straight path of movement of the web where one or more contactless drying means are directed onto the material web. Subsequently, the moving material web is deflected about the shell surface of a rotatable deflection roll, an air cushion being formed between the shell surface of the roll and the material web so that the material web is deflected without making contact.

A mode of application is denoted by the term "direct application" of a liquid or pasty medium when an application means directly applies the coating medium, the latter being supported on a counter-surface which, for example, is in the form of a rotatable counter-roll or a moving endless belt. An application mode is denoted by the term "indirect application" of a liquid or pasty medium when the coating medium is initially applied onto an application surface such as the shell surface of an application roll and then transferred onto and pressed into the material web from this location in a roll gap through which the material web is guided.

An apparatus is described in the published patent application DE 44 16 399 A1 in which a coating medium is initially pressed into the moving material web in a roll gap by means of an indirect application means and then, after passing a straight path of movement of the web, this moving material web is deflected contactlessly on an air cushion over a stationary deflection means into a new direction of movement of the web.

In apparatus of the previously described kind, particularly when the coating medium is directly applied onto the material web, i.e. not pressed into it, it is possible that a throwing out of the applied coating medium occurs during the contactless deflection. This leads to an uneven coating of the material web. Further, a satisfactory uniformity of the applied film of coating medium is not sufficiently guaranteed.

In this regard, it is suggested in the published patent application DE 44 29 964 A1, after the application of an excess of coating medium, to guide the moving material web in such a concavely curved manner, at least along a partial stretch up to a scraping means at which the excess coating medium is scrapped off, that centrifugal forces act in the direction towards the web. In this manner, a spattering of coating material and an uneven coating of the coating medium are avoided and, by means of the centrifugal forces, a evening out of the applied film of coating medium is to be effected.

SUMMARY OF THE INVENTION

The invention is based on the technical problem of providing a method and an associated apparatus for the application of a liquid or pasty medium onto a moving material web in which a good and even penetration of the applied liquid or pasty medium into the moving material web is realized in a comparatively simple manner.

The inventive solution is based on the concept of utilizing the centrifugal force acting along a curved path of motion of the web on the material web during a deflection of the material web for a better and more uniform penetration of an applied liquid or pasty medium. Thus, in accordance with the invention, the liquid or pasty medium is applied directly onto one side of a moving material web and the moving web is passed immediately after the application of the medium along a curved path of motion or the leading-in to a curved path of motion for the material web is effected shortly before the direct application of the medium. Therefore, in the first case, the effect of the centrifugal force on the material web on account of the curved path of motion is initiated immediately after the direct application of the medium and, in the second case, the direct application of the medium takes place in the area of effect of the centrifugal force on the moving material web since the material web is already on a curved path of motion at the point in time of direct application of the medium. In this case, the direction of curvature of the path of motion of the moving material web is selected such that the centrifugal force acting during the passage of the web presses the applied liquid or pasty medium into the material web. Thus, the material web on the side upon which the liquid or pasty medium is applied passes through a concave curve so that the direction of effect of the centrifugal force is towards the material web on the coating side of the material web. In the method according to the invention, the uniform distribution of the applied medium on the material web and a uniform penetration of the applied medium into the material web take place exclusively by way of the effect of the centrifugal force. Consequently, on account of the method according to the invention, a considerable simplification and reduction in cost of the operating process required for treating the material web is achievable.

The inventive solution is also based on the concept of particularly simplifying the method of application of a liquid or pasty medium and the associated apparatus in such a manner that the liquid or pasty medium is applied in the form of a free or open jet onto a contactlessly guided section of the moving material web. In accordance with the invention, it has been recognized that the medium to be applied can be applied as a free or open jet onto the moving material web without the moving material web having to be supported in this section of application at its side which is not to be coated. In conventional solutions, the moving material web is guided at the location of application on a counter-surface and supported thereon. Such counter-surfaces are usually designed as rotating counter-rolls upon the shell surface of which the material web is supported in the application section, or as rotary support belts with the material web being supported on their upper surface. In the inventive solution, such counter-rolls, supporting belts or the like are no longer required at the location of application so that a more compact and less complicated arrangement results. Additionally, it is now possible by means of the inventive method to apply the liquid or pasty medium during the contactless deflection, i.e. to position a free jet application unit opposite a deflection guiding surface for the contactless deflection of the moving material web. This is because the section of the material web on the side not to be coated and opposing the application unit must not be kept free for the arrangement of a supporting counter-surface but can be used for placement of the contactless deflection means. In accordance with the invention, the liquid or pasty medium is then applied as an open or free jet onto the free, i.e. floating material web.

In the inventive method, since the liquid or pasty medium is applied directly onto the moving material web in a desired and finally dosed amount of coating, i.e. the medium to be applied onto the moving material web as an open jet is already dosed to the desired final amount of application, a subsequent scraping off of excess coating medium is no longer required. In terms of processing technology, this is significantly easier and cheaper because only that amount of liquid or pasty medium must be applied which should actually remain on the material web. Furthermore, pumping energy which would otherwise be required for removing the excessively applied medium after scraping, is saved. In this manner, the inventive method is significantly simplified as compared to conventional methods and a more compact and less complicated arrangement results.

In a useful exemplary embodiment, the curvature of the curved path of motion of the moving material web is set in such a manner that the resulting force consisting of a dewatering force from the material web towards the medium, the centrifugal force effective on the applied medium and the weight effective on the applied medium, is directed from the applied liquid or pasty medium towards the material web. The resulting force which acts on the applied liquid or pasty medium is therefore used to enhance the penetration of the medium into the material web and the uniformity of the coating surface.

In a preferred embodiment of the inventive method, the curved path of motion of the material web during the contactless deflection corresponds to a circular arc section. If required, however, other curved paths of motion can be provided.

A further preferred embodiment of the inventive method consists in simultaneously performing a drying of the material web during the deflection of the material web previously provided with a liquid or pasty medium.

In accordance with another design feature of the inventive method, steam is applied during the deflection or even directly after this onto the applied medium. In this manner, the viscosity of the medium is reduced and the medium flows better or penetrates better into the material web.

Therefore, in accordance with the invention, the centrifugal force is utilized during the deflection of the web to produce good penetration of the applied medium and to achieve an internal networking of the medium with the material web. On account of the effect of the centrifugal force during the deflection of the material web, the surface of the layer of liquid or pasty medium applied onto the material web is simultaneously made even and flat. Furthermore, it can no longer occur in the solution according to the invention that the liquid or pasty medium is thrown outwards or spattered during deflection of the material web after direct application because the centrifugal force presses the medium into the material web in accordance with the invention. Additionally, in the inventive method, a very compact structural arrangement results because the process of direct application of the medium is moved directly adjacent to the deflection operation in spatial terms or even ensues in parallel. A very compact structural arrangement also results in that the application of the medium in accordance with the invention ensues without a counter-surface for supporting the material web in the area of application. A simultaneous drying of the coated material web during the deflection procedure enables realization of the structural compactness of the three process steps application, deflection and drying.

If required, it is naturally possible by. means of the inventive method to additionally also coat the second side of the moving material web with a liquid or pasty medium. For example, the inventive method steps can be performed twice in succession for this purpose, once for the first web side and once for the second material side. However, coating of the second web side can also take place simultaneously with that of the first web side. although, during the deflection of the material web, the second web side will be subject to the effect of a centrifugal force which is directed away from the material web. Depending on the actual mode of application, the effect of the centrifugal force on the second web side which passes through a convexly curved path may be less problematic if, for example, a different medium less susceptible to being thrown out is applied onto this second web side or the medium is applied on that side with a different thickness, consistency etc.

In the use of specific types and/or types of liquid or pasty medium which are difficult to process, it has been established that even in the case of contactless deflection of the moving material web, as described above, the required uniform penetration of the applied medium into the moving material web can not be or is not always realized. Further, in the case of contactless deflection of the moving material web without this being supported, for example, by a counter-surface on its side which is not to be coated, the tension of the moving material web is only adjustable or controllable with difficulty. A web tension which is too low or irregular leads to nonuniformity of the application of the liquid or pasty medium on the material web and thus to a disimprovement in the quality of the application.

In this context, there is therefore the additional requirement in respect of a previously described method and the associated apparatus, to be described in the following, to achieve a uniform penetration of the applied liquid or pasty medium into the moving material web and simultaneously improve the uniformity of the application also when utilizing specific types of liquid or pasty medium.

A further advantageous design feature of the inventive method therefore provides for the application of a subpressure at the side of the material web opposite the section which is guided without contact.

Since the provision of a supporting counter-surface is not required in accordance with the inventive solution so that the area opposite the application unit and the deflection means on the side of the material web which is not to be coated remains vacant, this area is used in accordance with the invention to position a subpressure generating means. A subpressure is applied by means of the subpressure generating means at the side of the material web facing away from the contactlessly guided section. This makes it possible to further increase the curvature of the material web after the application of the liquid or pasty medium. On account of the strongly curved path of motion, the effect of the centrifugal force on the material web is increased and a uniform penetration of the applied liquid or pasty medium is therefore ensured. Consequently, critical types of liquid or pasty medium which normally require a large input of centrifugal force so as to be sufficiently pressed into the material web for an acceptable application film, can be processed without difficulty to a uniform coating on the material web. Additionally, the web tension is adjustable and controllable by applying the subpressure so that a uniform coating application across the entire width of the material web is guaranteed for areas which are loaded to a different extent. Furthermore, the applied subpressure supports the guidance of the coated material web in its contactlessly guided section so that the material web has the required tension for each application medium even without the presence of a supporting counter-surface such as counter-rolls or supporting belts.

Further, the free, i.e. floating material web is always sufficiently supported by the application of the subpressure in order to withstand the loads of the strong effects of the centrifugal forces. This reduces the risk of tears in the material web.

In a preferred embodiment of the inventive method, the material web is guided respectively before and after the deflection by means of at least one curved support surface at the side of the material web which faces away from the contactlessly guided section. For example, rotating support rolls or support belts can be provided. In this manner, the material web is additionally supported and held along its curved path of motion so that the material web maintains its direction of movement and does not tear even in the case of strong centrifugal forces. Furthermore, depending on the arrangement of the support surfaces ahead of and behind the deflection section, the curvature of the curved path of motion can be varied. By means of the support surface arranged upstream of the deflection section, the material web is guided into the deflection section at a certain angle while the support surface arranged downstream of the deflection section guides the material web out of the deflection section. In this manner, the direction of movement of the material web before and after the deflection can be predetermined.

Therefore, the curvature of the curved path of motion of the material web can be adjusted according to the invention in such a manner that the material web passes through a deflection of preferably 180° between the support surfaces. Depending on the desired effect of the centrifugal force on the material web and, therefore, the depth of penetration of the liquid or pasty medium into the material web, the deflection of the material web between the support surfaces can be varied between 40° and 270°.

A further preferred embodiment of the inventive method consists in applying the subpressure without contact. In this manner, the material web is additionally supported during the deflection without direct contact with a counter-surface being required. This contributes to a protective guidance of the web because the material web is not placed under a load by mechanical contact with a counter-pressure surface.

Another advantageous design feature of the invention consists in that the tension of the moving material web can be controlled and/or regulated by means of a locally different and/or uniform adjustment of the subpressure across substantially the entire material web width. This controllability or regulatability permits a quick and uncomplicated adaptation of the tension in the material web to different factors which have a relevant influence on the quality of the coating to be achieved, such as the type of liquid or pasty medium to be applied, the speed of movement and the amount of curvature of the moving material web and, thus, the centrifugal force acting on the material web.

It has proved to be particularly advantageous to end the contactless deflection after a starting-up or running-in phase of the material web. In this case, after the start-up phase, the material web is solely held along its curved path of motion by means of the centrifugal force acting thereon and the subpressure applied on the side of the material web not to be coated.

The inventive apparatus for implementing the previously described method comprises an application means for the direct application of a liquid or pasty medium onto one side of a moving material web as well as contactless deflection means with a curved guiding surface. In accordance with the invention, the application means is a free or open jet application unit which acts to dose the medium in the finally desired amount (finalized dosing application unit) or is designed as an extruder application unit and associated with a contactlessly guided section of the material web. In this case, the free jet application unit is arranged directly in front of the deflection means or opposite the guiding surface of the deflection means. The moving material web is then guided on an air cushion over the curved guiding surface such that the side of the material web which is to be coated with a liquid or pasty medium passes through a concave curve.

The free jet application unit can be designed in accordance with the invention as a free jet nozzle application unit in the form of a so-called "curtain flow" application unit in which the medium to be applied flows down like a waterfall over an overflow edge, or in a similar manner. In the free jet nozzle application unit, the medium to be applied is applied by means of a nozzle which is normally formed between two longitudinally extended lip members.

In view of this, an arrangement of the apparatus which saves considerable space results because the application unit is arranged directly in front of or parallel to the deflection means and there is no requirement for a counter-surface to support the material web at the location of application and, preferably, an additional scraping or finish-dosing means arranged downstream of the free jet application unit is also not required.

Further advantages of the inventive apparatus correspond to those already explained in connection with the inventive method.

Should the application unit be arranged directly in front or ahead of the deflection means, a suitable embodiment consists in forming the guiding surface of the deflection means to be convexly curved, the side of the moving material web which was previously coated by the application means with a liquid or pasty medium facing towards the guiding surface when passing this. Therefore, in this embodiment, the material web can, for example, pass over a shell surface section of a roll and, during passage through this deflection, the previously applied medium is located on that side of the material web which faces the shell surface of the roll. The applied medium is therefore enclosed between the moving material web and the guiding surface of the deflection means, for example the shell surface of a roll, and is pressed into the material web by the centrifugal force effective outwardly as seen with respect to the guiding surface. Spattering or throwing off of the applied medium is therefore prevented by the material web itself. As there is no space in this arrangement between the moving material web and the convexly curved guiding surface for placing the application means, the application means is provided directly in front of the deflection means.

Another preferred embodiment of the inventive apparatus consists in forming the guiding surface of the deflection means to be concavely curved, the side of the moving material web to be provided with the liquid or pasty medium then facing the guiding surface when it passes this. In this embodiment, for example, a concavely curved, stationary guiding surface can be used. The applied medium is not "enclosed" between the material web and the guiding surface in this embodiment but is located on the side of the material web which faces away from the guiding surface. During passage through the curved path of motion, the centrifugal force now acts towards the guiding surface so that the applied medium is again pressed into the material. In contrast to the previously described embodiment with a convexly curved guiding surface, however, the application means can be arranged either directly ahead of the deflection means or it can be positioned opposite the guiding surface. Therefore, depending on the mode of use, the medium can be applied onto the material web before passage along the curved path of motion or it can be applied onto the material web during passage along this curved path. Therefore, in the first case, the centrifugal force becomes effective immediately after application while, in the second case, the medium is immediately introduced into the area of effectiveness of the centrifugal force.

Both in the case of a convex as well as a concave guiding surface of the deflection means, a preferred embodiment consists in forming the guiding surface as a circular arcuate section.

In a useful embodiment, a rotary type guiding surface is provided, for example, the shell surface of a rotating roll or the upper surface of a circulating continuous belt. In the case of a roll, its shell surface usefully has a circular curvature while other geometric curvatures for a rotary guiding surface can be realized when using an endless belt.

Another useful embodiment consists in providing a stationary guiding surface. In this case, any desirable geometries of curvature can be realized, in particular also a circular curvature.

In the case of a moving guiding surface of the deflection means, but also in the case of a stationary surface, in particular when this has a large radius of curvature, the air boundary layer moved along together with the moving material web can already be sufficient to form the desired air cushion between the material web and the guiding surface so that the deflection ensues with contact. The aspect of contactless deflection is particularly significant in the use of a convexly curved contact surface because the applied liquid or pasty medium would otherwise contact the guiding surface, which may lead to irregularities in the applied layer and, additionally, to a soiling of the guiding surface. The basic principle of an air boundary layer cushion is known from the initially discussed DE 44 15 581 C2.

In a useful embodiment of the inventive apparatus, there is provided at least one means for blowing air into the region between the moving material web and the guiding surface. In this case, the formation of an air cushion for contactless deflection of the moving material web is enhanced by the act of blowing in air. The air is blown between the moving material web and the guiding surface by at least one means and, preferably, tangentially to the direction of movement of the material web. On account of tangential blowing of the air, the moving material web is thereby placed only under an extremely small load. Another variant consists in blowing the air substantially perpendicular to the material web, i.e. in the form of an impact air stream. However, the material web is placed under a substantially greater load in this case. Consequently, the tangential air stream reduces the risk of tears in the material web.

An expedient embodiment consists in arranging at least one air nozzle at the inlet side in the area where the deflection means begins, i.e. on the side at which the material web is fed into the deflection means. Therefore, the at least one air nozzle can be arranged directly in front of the deflection means or at the inlet side area of the guiding surface.

A further useful embodiment consists in providing the guiding surface of the deflection means with air nozzles or through-openings for air. The air nozzles can be distributed along the guiding surface and a tangential flow direction as well as a radial flow direction with reference to the guiding surface is again possible. The air nozzles along the guiding surface can be provided in addition to or alternatively to air nozzles directly in front of the guiding surface. Air nozzles can be provided in particular for stationary guiding surfaces while air openings are especially useful for moving guiding surfaces, for example, the shell surface of a rotating roll or a circulating endless belt. In the case of moving guiding surfaces which are provided with air openings, stationary air nozzles can then be provided inside the guiding surface, for example, in a form of a stationary blowing chamber. The air that has been blown in can pass through the air openings of the moving guiding surface and form the desired air cushion on the guiding surface.

A further embodiment of the invention consists in providing, in the area of the deflection means opposite the guiding surface, a second guiding surface extending substantially equi-distantly to the guiding surface. The moving material web then passes between the two guiding surfaces. Therefore, a type of through-channel is created which is bordered by two guiding surfaces and along which the material web is deflected along a curved path of motion. The second guiding surface can also be provided with air nozzles or air openings in order to additionally stabilize the passing material web from the other side during its contactless passage.

In a preferred embodiment, at least one contactless drying means is provided in the area of the deflection means. For example, the contactless drying means can be in the form of an infrared dryer or the like. Such dryers can, for example, be arranged opposite the guiding surface. If a means for blowing in air is provided to enhance the formation of an air cushion for the contactless deflection, the contactless drying means can also consist in operating the means for blowing in air at least partially with warm air. Such warm air nozzles can naturally be combined with further dryers such as infrared dryers.

In accordance with the invention, it is also possible as a further design feature to provide at least one contactless drying means behind (downstream of) the deflection means. For example, the contactless drying means can again be in the form of infrared dryers of the like and be arranged opposite the coated side of the material web. This inventive arrangement of a drying means behind the deflection means has the effect that the applied medium can even out on the material web before the drying process.

Therefore, according to the invention, a very compact and space-saving apparatus can be realized. Since the inventive method operates with a direct application of the liquid or pasty medium, application and pressing rolls as provided, for example, in the arrangement described initially with reference to DE 44 16 399 A1, are not required. The rolls required for forming the roll gap in the indirect application method described therein are additional components which make the unit more complicated and require additional structural space. The pressing function which is performed by the roll gap and on account of which a subsequent throwing off of the medium from the material web is substantially prevented, is superfluous in the inventive solution on account of the use of the centrifugal force to press the medium into the material web.

According to a preferred design feature, the inventive apparatus has at least one steam applying means by which steam can be applied onto the coated medium during the deflection. Therefore, it is possible in an advantageous manner to reduce the viscosity of the medium and the medium can therefore flow even better.

As already indicated above in connection with the inventive method, with a view to the use of specific types and/or types of liquid or pasty medium which are different in terms of processing, it has proved to be useful to provide within the framework of a further variant of an embodiment of the inventive apparatus at least one subpressure generating means which is located essentially opposite the contactless deflection means to apply a subpressure on a side of the material web facing away from contactlessly guided section. Therefore, it is possible both on account of the deflection means and the application of a subpressure with the subpressure generating means to effect the concave curvature of the material web. Additionally, by applying the subpressure along its curved path of motion, the material web is stabilized and held so that a supporting counter-surface is not required. Further, the web tension can be purposefully adjusted by means of the subpressure generating means in order to realize a uniform coating application across the entire width of the material web.

Advantageously, in front of (upstream of) and behind (downstream of) the contactless deflection means on the side of the material web opposite the contactlessly guided section, there is at least one curved support surface, for example a support roll or a moving support belt. In this manner, the moving material web is exactly and precisely guided and held along its curved path of motion.

In this context, it has also proved to be of advantage to provide the support surfaces respectively upstream and downstream of the deflection means opposite each other and at a certain spacing. By varying the spacing of the opposing support surfaces, the radius of curvature and, thus, the amount of concave curvature of the moving material web in the area of deflection can be defined. In this case, the support surfaces are preferably arranged in such a manner with respect to each other that half the spacing between the two support rolls corresponds approximately to the radius of curvature of the material web. The smaller the selected spacing between the support surfaces, the smaller the radius of curvature and, therefore, the centrifugal force acting on the applied liquid or pasty medium is increased. This in turn contributes to the uniformity of the coating layer on the material web.

In a useful embodiment, the subpressure generating means is arranged at a distance from the side of the material web facing away from the contactlessly guided section. In this manner, a gentle guidance and support of the material web is realized because no direct contact exists between the subpressure generating means, acting as a guiding means, and the material web. The material web is therefore guided without contact both at its coated and its uncoated side so that the applied liquid or pasty medium does not come into contact either with the guiding surface of the deflection means or with the subpressure generating means, which could lead to irregularities in the applied layer and, additionally, to a soiling of the guiding surface of the deflection means.

A further variant of an advantageous embodiment consists in the inventive apparatus having at least one control and/or regulating means associated with the subpressure generating means for locally different and/or substantially the same adjustment and/or regulation of the subpressure across the entire width of the material web. Such a control and/or regulating means is particularly advantageous with respect to an adjustment and/or regulation of the subpresaure during the operation of the apparatus. In particular, it is possible to include the control or regulating means in an automatic control loop which regulates the setting of the subpressure across the material web width on the basis of measured values of the web tension. This permits the quickest possible adaptation of the subpressure and, therefore, the web tension to varying conditions such as irregularities occurring during the operation or due to the use of a different type of liquid or pasty medium.

Finally, it has also proved to be advantageous that the apparatus includes a switch-off means associated with the contactless deflection means for the selective ending of the contactless deflection of the material web after a running-in or starting-up phase of the material web. This switch-off means can be a manually actuatable or automatic switch-off means. In this case, an automatic switch-off means can also be incorporated in a control circuit which effects the switching off of the deflection means at a specific speed of movement. Therefore, for example, air nozzles which are distributed along the guiding surface of the deflection means and by means of which a tangential and/or a radial stream of air as seen with reference to the guiding surface can be created for the formation of an air cushion, are switched off. This results in the great advantage that the applied liquid or pasty medium is not blown out of the deflection means by the incoming air and the coated layer is not caused to become uneven. In contrast, the subpressure applied to the material web from the other, uncoated side ensures that the curved path of movement of the passing material web continues to be held and stabilized.

BRIEF DESCRIPTION OF THE DRAWINGS

The invention is described in more detail in the following by way of preferred exemplary embodiments with reference to the enclosed drawings, in which.

DETAILED DESCRIPTION OF THE INVENTION

Figure 1:
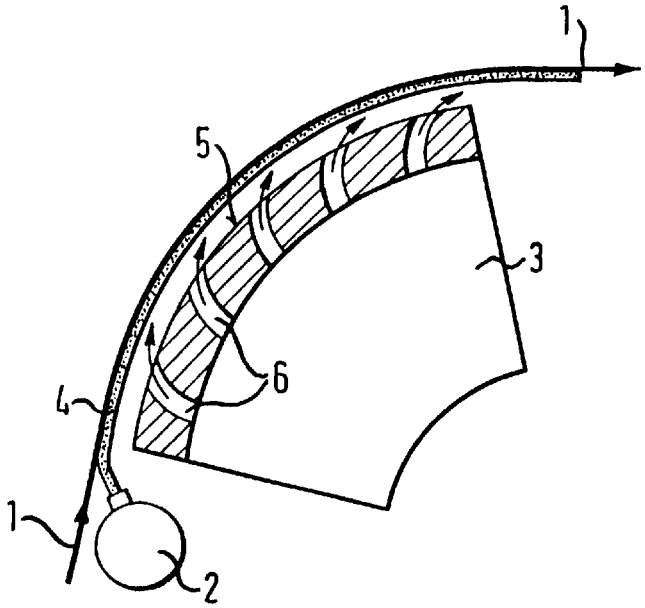
FIG. 1 shows a first exemplary embodiment of the inventive apparatus in a schematic side view.

In the first exemplary embodiment FIG. 1, a stationary deflection means 3 is provided which has a guiding surface 5. The guiding surface 5 is convexly curved and has the shape of a circular arc section. The deflection means has a plurality of nozzles 6 which open into the guiding surface 5 in a direction approximately tangential to the guiding surface. A moving material web 1 consisting, for example, of paper, cardboard or a textile material, is led past the guiding surface 5. The direction of passage of the web 1 is indicated by arrows. Arranged directly in front of the deflection means 3 is a free or open jet nozzle application unit 2, shown in simplified form.

In passing the application unit 2, a liquid or pasty medium 4 such as a pigment-containing colour, impregnating fluid, starch or the like is applied in a free jet. The application of the medium 4 through the application unit 2 ensues in this case on that side of the web 1 which faces the guiding surface 5. The moving web 1 is not supported in the section of application, namely the section in which the jet impinges, but moves freely along the predetermined path of passage of the web. After application of the medium 4, the web 1 passes through a path deflection along the convexly curved guiding surface 5. As indicated by the flow arrows in FIG. 1, air is blown through air nozzles 6 approximately tangentially to the direction of passage of the material web and between the web and the guiding surface such that an air cushion is formed at this location which flows along with the web 1. In this manner, the web 1 is only subjected to a minimal load and is deflected without contacting the guiding surface 5. The quality of the previously applied layer of the medium 4 is therefore not impaired during deflection. While the web 1 passes along the curved path of passage of the web at the guiding surface 5, a centrifugal force acts on the side of the web coated with the medium 4 which faces the web 1 and thus forces the medium towards the web. As a result, the medium penetrates the web 1 and an internal networking of the medium with the web occurs. Additionally, on account of the effect of the centrifugal force, the surface of the guide layer becomes even and smooth. As can be seen in FIG. 1, the web side coated with medium 4 passes a concavely curved web section so that the centrifugal force acts in the direction of the coated web side and thus supports the penetration of the medium into the web 1. The liquid or pasty medium 4 is already applied onto the web 1 in the finally dosed and desired amount of application by the free jet nozzle application unit 2. Therefore, there is no requirement for a supporting means for the web at the location of application and an additional final dosing means such as a means with a scraping blade is not required. The structure as a whole therefore becomes very compact, since it comprises a smaller number of components as compared to conventional structures and is simpler and less complicated in structure.

In the further exemplary embodiments shown in FIGS. 2 to 7, the same or corresponding components have the same reference signs as in FIG. 1 so that reference is made to the explanations above relating thereto.

Figure 2:
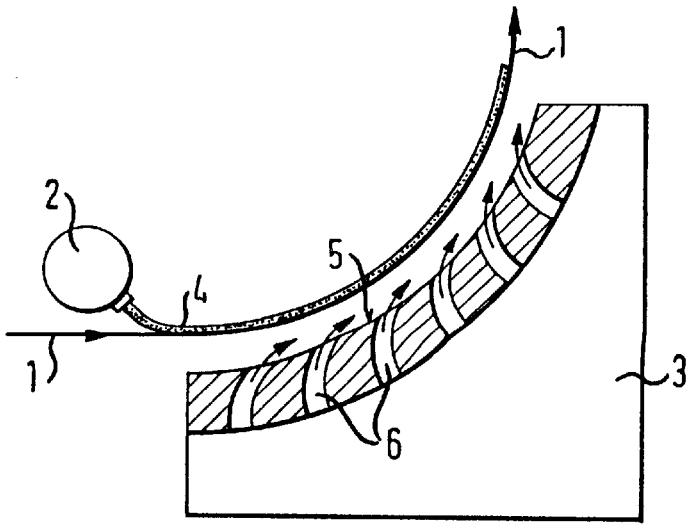
FIG. 2 shows a second exemplary embodiment of the inventive apparatus in a schematic side view.

In the second exemplary embodiment in FIG. 2, a deflection means 3 is provided which has a concavely curved guiding surface 5. The web is again deflected along the guiding surface 5. In this case, the web 1 again moves contactlessly on an air cushion which is formed between the web 1 and the guiding surface 5. In contrast to the first exemplary embodiment in FIG. 1, the free jet nozzle application unit 2 is now arranged not on that web side which faces the guiding surface 5, but on the web side which faces away from the guiding surface 5. This web side facing away from the guiding surface 5 passes through a concavely curved web section, as shown in FIG. 2, such that the centrifugal force created during the deflection phase forces the applied medium 4 back into the web. The free jet nozzle application unit 2 is, as in the case of the first exemplary embodiment, arranged directly in front of the deflection means 3. In both exemplary embodiments shown in FIGS. 1 and 2, the so-called Coanda effect is also used, which produces a good adherence of the air stream along the guiding surface and encourages a good lie of the web 1 on the air cushion.

Figure 3:
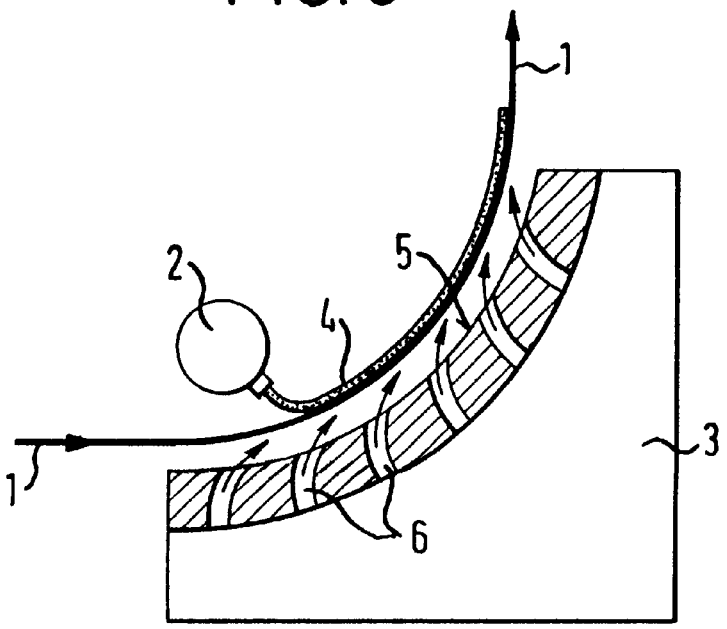
FIG. 3 shows a third exemplary embodiment of the inventive apparatus in a schematic side view.
Figure 4:
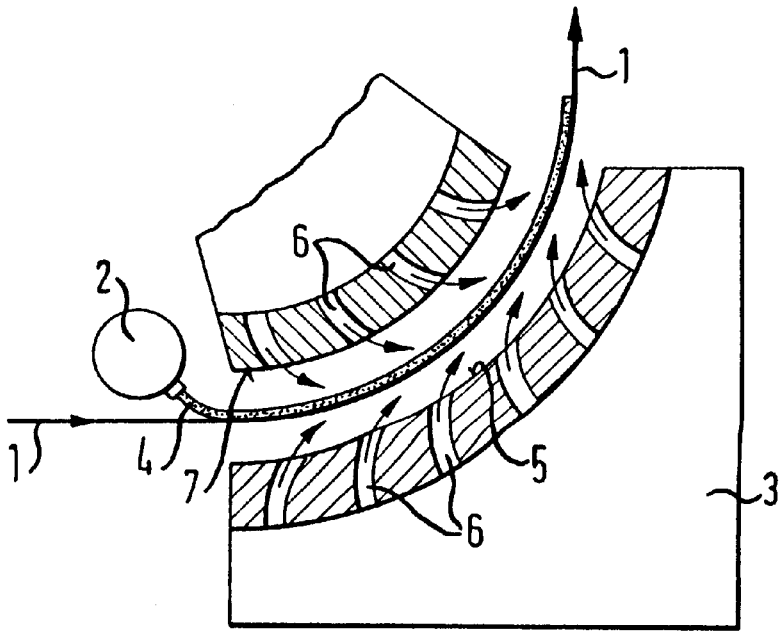
FIG. 4 shows a fourth exemplary embodiment of the inventive apparatus in a schematic side view.

In the exemplary embodiment in FIG. 2, structural space still remains behind the application unit 2 on that web side which is coated, with the medium 4 so that it is possible to provide contactless dryers such as infrared dryers at this location. As illustrated in the third exemplary embodiment in FIG. 3, the structural space available to the right of the application unit 2 in FIG. 2 can also be used to arranged the application unit 2 within the deflection zone. In FIG. 3, the free jet nozzle application unit 2 lies opposite the guiding surface 5 and the application of the medium 4 therefore already ensues in the effective area of the centrifugal force. As shown in the fourth exemplified embodiment in FIG. 4, the structural space available to the right of the application unit 2 in FIG. 2 can also be used to provide a further guiding surface 7 at that location which extends at a distance from the guiding surface 5 and is curved in a manner appropriately adapted to this. The web 1 passes through the two guiding surfaces 5 and 7. The guiding surface 7 is also provided with air nozzles 6 which open approximately tangentially to the direction of passage of the web. The web guidance is further stabilized in this exemplary embodiment by means of the air cushion blown in through the guiding surface 7. For example, the air blown from the guiding surface 7 can also be warm air so that this additionally injected air stream simultaneously performs a drying function in addition to the stabilizing function. In the same manner, the air blown in from the guiding surface 5 can naturally be appropriately preheated in order to predry the web 1 during deflection.

Figure 5:
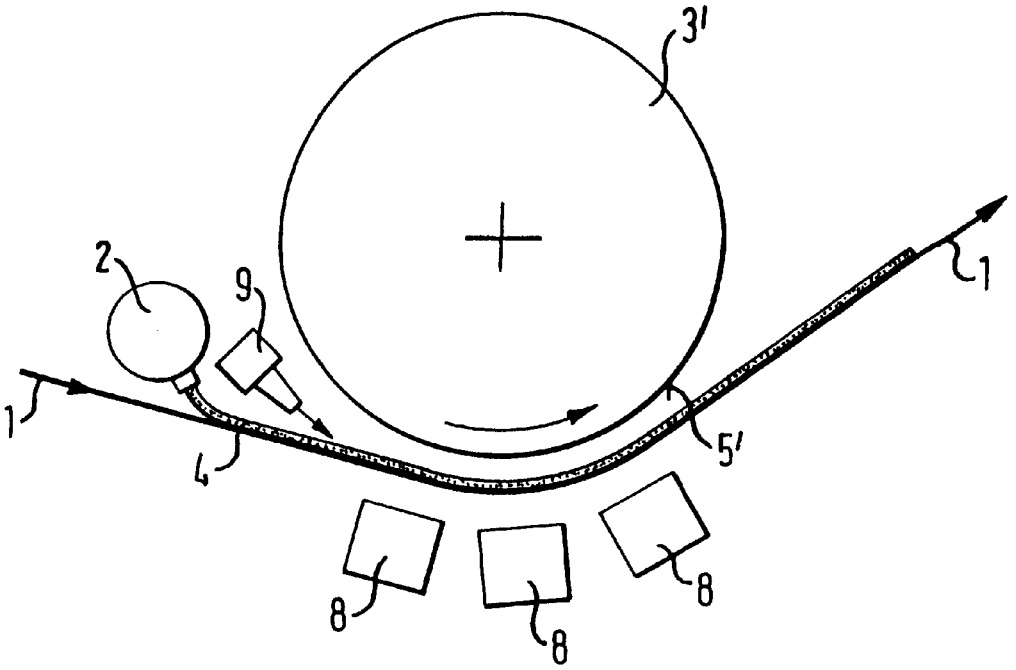
FIG. 5 shows a fifth exemplary embodiment of the inventive apparatus in a schematic side view.

In the fifth exemplary embodiment in FIG. 5, the deflection means is now denoted with a reference sign 3' as, contrary to the previously described exemplary embodiments, it is not a stationary deflection means but a rotary deflection means. This rotary deflection means is in the form of a rotary deflection roll 3', the shell surface of which serves as a rotary guiding surface 5'. The direction of rotation of the deflection roll 3' is indicated by an arrow. Directly in front of the deflection roll', there is a free jet nozzle application unit which applies the medium 4 on that side of the web 1 which faces the rotary guiding surface 5', namely the roll shell surface. Similarly as in the preceding exemplary embodiments with a stationary deflection means 3, the web 1 is also deflected here in a contactless manner on an air cushion and, on account of the curved passage of movement of the web, a centrifugal force acts which presses the applied medium 4 into the web. In FIG. 5, an air nozzle 9 is provided which blows air into the area between the deflection roll 3' and the web 1. The air nozzle 9 is arranged in the area of introduction of the web 1 into the deflection zone and blows in the air in a direction approximately tangential to the direction of web movement. The rotary guiding surface 5' is opposed by contactless dryers 8 such as infrared dryers in order to predry the previously coated web 1 during deflection.

Alternatively, in the exemplary embodiment in FIG. 5, it is also possible to omit the air nozzle 9. The air cushion between the deflection roll 3' and the web 1 is then formed by an air boundary layer which is carried along by the web 1 as it moves therethrough at a relatively high speed. Particularly in the case of comparatively high rotary speeds of the deflection roll 3', a stable boundary layer air cushion can be formed even without the additional blowing in of air.

Figure 6:
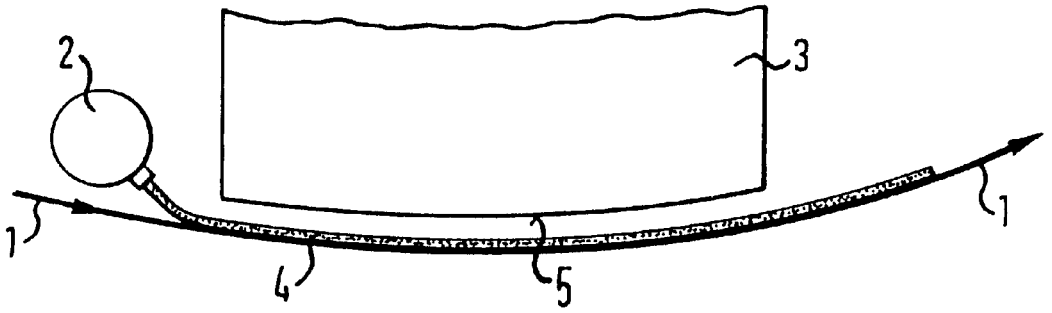
FIG. 6 shows a sixth exemplary embodiment of the inventive apparatus in a schematic side view.

The sixth exemplary embodiment in FIG. 6 shows such a web deflection along a curved web section on a boundary layer air cushion. The deflection means 3 is again a stationary deflection means, but the additional blowing in of air in the region between the guiding surface 5 and the web 1 can be omitted particularly on account of the comparatively large radius of curvature of the guiding surface 5. The boundary layer air cushion in this configuration is sufficient for the contactless web deflection.

Figure 7:
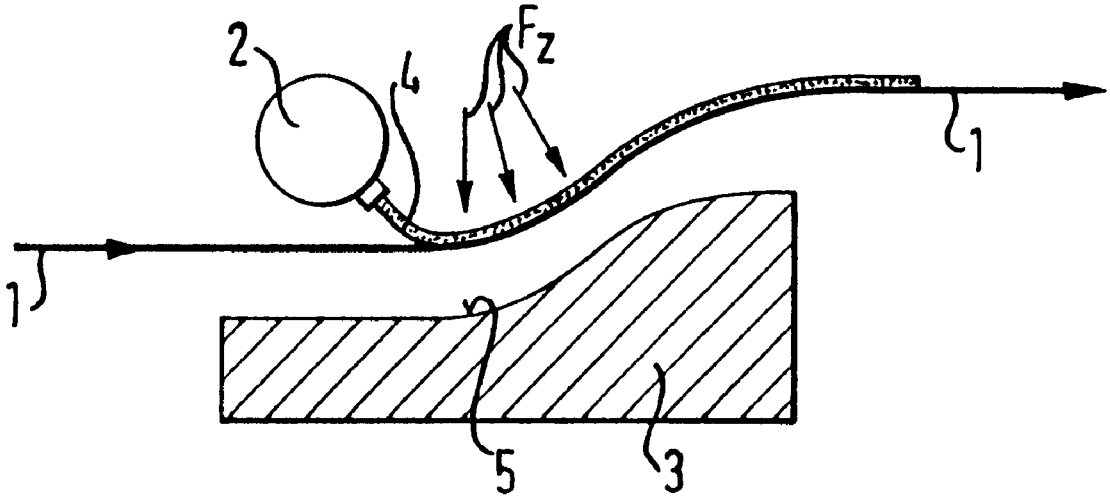
FIG. 7 shows a seventh exemplary embodiment of the inventive apparatus in a schematic side view.

In the seventh exemplary embodiment in FIG. 7, a stationary deflection means 3 is shown with a guiding surface 5 which is curved in a circular arcuate manner along one deflection section. The free jet nozzle application unit 2 is arranged opposite this concavely curved deflection section of the guiding surface 5. The web 1 is again deflected along the guiding surface 5 on an air cushion without contact, the medium being applied in that section of web movement in which the web is subjected to a centrifugal force $F_Z$ on account of the curved web passage which—as seen from the side of the web to be coated—acts in the direction towards the web. The medium is therefore pressed into the web 1 immediately upon application and along the following curved passage of the web.

As the preceding exemplary embodiments show, the inventive apparatus can be realized in a structurally very compact manner since the application unit 2 can be arranged either directly in front of the deflection means 3, 3' or opposite the guiding surface 5 of the deflection means 3 because supporting counter-rolls, endless belts or the like at the location of application are not required and a separate final dosing means for scraping off excess medium is unnecessary. Additional drying means can also be provided in this area in a structurally compact manner, either integrated in the deflection means 3, for example, in the form of hot air nozzles 6, or separately in the form of contactless dryers 8 such as infrared dryers.

Figure 8:
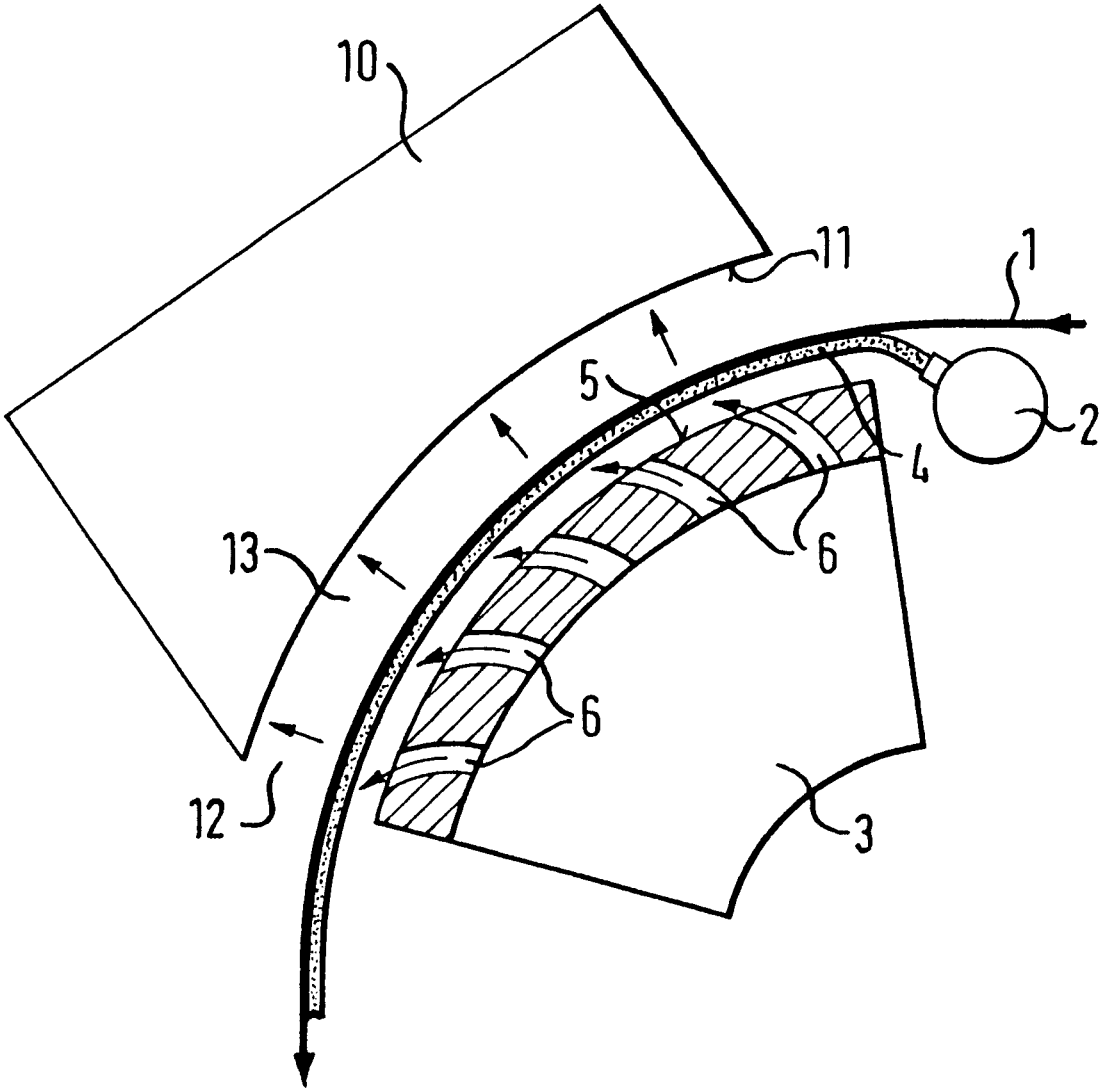
FIG. 8 shows a schematic side view of a partial secton of an eighth exemplary embodiment of the inventive apparatus.

FIG. 8 shows a schematic side view of an essential partial section of an eighth exemplary embodiment of the inventive apparatus. In a similar manner to the preceding exemplary embodiments, a stationary deflection means 3 is provided which has a convexly curved guiding surface 5. Air nozzles are formed in the deflection means 3 which open into the guiding surface 5 in a direction approximately tangential to the guiding surface 5. Opposite the deflection means 3, there is a subpressure generating means 10 which has a second guiding surface 11. The second guiding surface 11 extends substantially at an equal distance to the guiding surface 5 and is concavely curved in a manner appropriately adapted thereto. The moving material web 1 consisting, for example, of paper, cardboard or a textile material, is guided between the two guiding surfaces 5 and 11. Thus, a kind of through-channel 12 is formed which is bordered by the two guiding surfaces 5 and 11. The direction of passage of the material web is indicated with arrows. Directly in front of the deflection means 3, there is a free jet nozzle application unit 2, illustrated in a simplified manner.

In passing the application unit 2, the liquid or pasty medium 4 such as a pigment-containing colour, impregnating liquid, starch or the like is applied onto the material web 1 in the form of a free or open jet. During this, the application of the medium 4 by means of the application unit 2 ensues at that side of the material web 1 which faces the guiding surface 5. The moving material web 1 is not supported in the region of application, namely in the region in which the free jet impinges upon the web 1, but moves freely along the predetermined path of passage of the web. Following application of the medium 4, the material web 1 passes through a web deflection along the concavely curved guiding surface 11 or the convexly curved guiding surface 5. As emphasized by the flow arrows in FIG. 8, air is blown through the air nozzle 6 approximately tangentially to the direction of passage of the material web 1 and between the material web 1 and the guiding surface 5 such that an air cushion is formed at this location which flows along together with material web 1 and carries this. As a result, the material web 1 is only subject to a minimal load and deflected without contacting the guiding surfaces. The quality of the previously applied layer of medium is therefore not adversely deflected during the deflection. As also visible in FIG. 8 and indicated by flow arrows, a subpressure is generated and applied on the material web 1 at the side of the material web which faces away from the contactlessly guided section. In this case, the subpressure generating means 10 suctions air out of an intermediate space 13 which is formed between the material web 1 and the second guiding surface 11. As a consequence of the resulting subpressure, a tension is applied to the material web 1 so that this is supported and held along its path of movement. The web guidance is therefore further stabilized in the area of deflection. While the material web 1 passes along the curved web path between the guiding surfaces 5 and 11, the web side provided with the medium 4 is subject to a centrifugal force which is directed towards the web 1 so that the medium 4 is pressed into the web 1. On account of this, the medium 4 penetrates the material web 1 and an internal networking of the medium 4 with the material web 1 results. The surface of the applied layer is also made more uniform and smooth on account of the effect of the centrifugal force. In the present case, the deflection means 3 is switched off after start-up of the apparatus, i.e. air is no longer blown through the air nozzle 6 between the material web 1 and the guiding surface 5. After switching off the deflection means 3, the material web 1 is exclusively guided and held along its curved path of movement by means of the applied subpressure. Consequently, the medium 4 applied onto the material web 1 is not blown away by air flowing in from the air nozzle 6. The deflection means 3 is therefore operated only for start-up until the material web has been stabilized along its final curved path of movement and is subsequently held along this path of movement exclusively by means of the subpressure generated by the subpressure generating means 10.

Additionally, the liquid or pasty medium 4 is applied by the free jet nozzle application unit 2 already in an amount application which is finally dosed. Therefore, apart from the supporting means for the web at the location of application, an additional final dosing means such as a means with a scraping blade is no longer required. In this manner, the structure as a whole becomes more compact as compared to conventional structures on account of the reduced number of components and is constructed in a simpler and less complicated manner.

Figure 9:
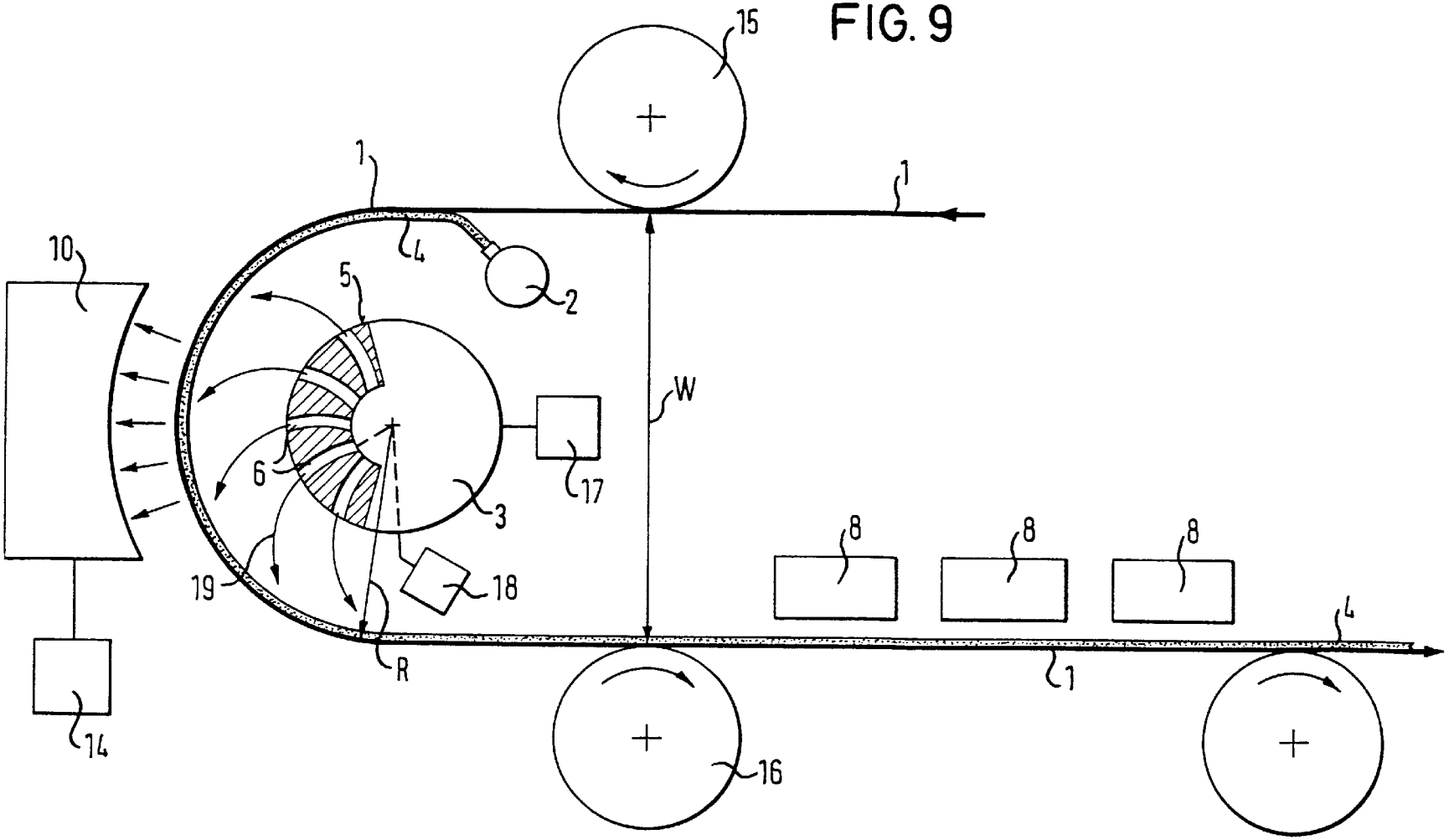
FIG. 9 shows a schematic side view of a ninth exemplary embodiment of the inventive apparatus, In the following description and in the drawings, the same structural parts and components are denoted with the same reference signs to avoid repetition insofar as no further differentiation is required.

Analogously to the mode of depiction in FIG. 8, FIG. 9 shows a schematic side view of a ninth exemplary embodiment of the inventive apparatus. The arrangement and operation of the individual apparatus components correspond to those of FIG. 8. Arranged directly in front of the deflection means 3 is the free jet nozzle application unit 2, which applies the medium 4 onto that side of the material web 1 which faces the guiding surface 5 of the deflection means 3. In the same manner as in the previous exemplary embodiment in FIG. 8, the material web 1 is deflected without contact on an air cushion and through application of a subpressure by means of the subpressure generating meats, and a centrifugal force takes effect on account of the curved path of motion of the web which presses the applied medium 4 into the material web 1. The air nozzles 6 are arranged in the region of the deflection zone and blow in the air approximately tangentially to the direction of movement of the web. After switching off the air supply through the air nozzle 6 by means of the switch-off means 17, the material web is held along its curved path of motion solely by means of the air pressure formed in the subpressure generating means 10. In this case, a control and regulating means 14 associated with the subpressure generating means 10 is locally differently adjusted and regulated across the entire width of the material web. Additionally, on account of the application of a subpressure at the uncoated side of the material web 1, the tension in the material web is set and/or regulated in such a manner that the required curvature for a specified liquid or pasty medium 4 is achieved.

Additionally, support rolls 15, 16 can be recognized in FIG. 9. The support roll 15 is arranged in front of the deflection means 3 as seen in the direction of movement of the web shown by means of the arrows in FIG. 9, while the support roll 16 is arranged behind or downstream of the deflection means. The support rolls 15, 16 are arranged at a spacing W, the material web 1 being guided at its side facing away from the contactlessly guided section by means of the support rolls 15 and 16, the shell surface of which serves as rotary support surface. The direction of rotation of the support rolls 15, 16 is shown by arrows. On account of the spacing W at which the support rolls 15, 16 are arranged with respect to each other, a radius of curvature R of the curved path of motion between the guiding surfaces 5 and 11 of the deflection and subpressure generating means is set. In this case, the radius of curvature R in the area of deflection corresponds to approximately half the spacing W between the two support rolls 15, 16 ($R \equiv W/2$).

The path of motion of the web predefined by the arrangement of the two support rolls 15, 16 is initiated or created by means of an air cushion blown in from the guiding surface 5, although the air supplied through the air nozzle 6 can also be maintained during operation for additional stabilization of the web guidance.

The apparatus has a steam applying means 18 by which steam 19 can be applied onto the applied medium 4 during deflection.

In the running out region of the material web 1 and, thus, behind the deflection and subpressure generating means, contactless dryers 8 such as infrared dryers are provided in order to dry the previously coated material web 1.

The present invention is not limited to the exemplary embodiments outlined above, which merely serve to generally explain the main concept of the invention. Rather, within the scope, the inventive method and the inventive apparatus can also have other designs to those described above. In particular, the method and the apparatus can have features which represent a combination of the features of the respective claims. It is also possible to provide the deflection means not as a stationary but as a rotary deflection means. Further, any desirable geometries of curvature for the guiding surface 5, 11 can be realized, but in particular a circular curvature. It is also conceivable to provide a means for blowing air into the area between the moving material web 1 and the guiding surface 5 in the form of an air nozzle in the area of the starting point of the deflection means. The air can also not only be blown tangentially to the direction of movement of the material web, but perpendicularly to this in the form of an impinging flow. Additionally, the application of the liquid or pasty medium can also ensue in the area in front of the support rolls 15.

Reference signs in the description and drawings merely serve for better understanding and shall not limit the scope.

We claim:

1. A method of application of a liquid or pasty medium onto a moving material web, comprising the following steps:

contactlessly deflecting the moving material web on a curved path of motion, the side of the moving material web to be provided with the liquid or pasty medium passing through a concave curvature, and directly applying the liquid or pasty medium immediately ahead of the deflection or during the deflection on a contactlessly guided section of a side of the moving material web, wherein the direct application of the liquid or pasty medium onto the contactlessly guided section ensues in a free jet, the medium being applied directly in a desired, finally dosed amount of application and the uniform distribution of the applied medium on the material web and a uniform penetration of the applied medium into the material web taking place exclusively by means of the effect of a centrifugal force.

2. The method according to claim 1, wherein the curvature of the curved path of motion of the material web is set in such a manner that the resulting force consisting of a dewatering force acting from the material web onto the medium, the centrifugal force ($F_Z$) acting on the medium and a weight acting on the medium, is directed from the liquid or pasty medium onto the material web.

3. The method according to claim 1, wherein during the deflection, a drying of the material web previously provided with the liquid or pasty medium also ensues.

4. The method according to claim 1, wherein steam is applied onto the applied medium during the deflection.

5. The method according to claim 1, wherein a subpressure is applied at a side of the material web facing away from the contactlessly guiding section.

6. The method according to claim 5, wherein the subpressure is applied in a contactless manner.

7. The method according to claim 5, wherein a tension of the moving material web is set and/or regulated by locally different and/or uniform adjustment of the subpressure across substantially the entire material web width.

8. The method according to claim 5, wherein the contactless deflection of the material web is ended after a run-in or starting-up phase of the material web.

9. The method according to claim 1, wherein the material web is guided respectively before and after the deflection at the side of the material web facing away from the contactlessly guided section by at least one curved support surface.

10. The method according to claim 1, wherein the curvature of the curved path of motion of the material web is set in such a manner that the material web passes through a deflection between the support surfaces of 40° to 270°, particularly 180°.

11. The method according to claim 1, wherein the contactless deflection of the material web is ended after a run-in or starting-up phase of the material web.

12. An apparatus for direct application of a coating medium onto a side of a moving fiber material web, said apparatus comprising:

means for contactlessly deflecting the moving fiber material web, said deflection means including a guiding surface with a concave curvature with which the moving fiber material web is associated, the side of the moving fiber material web having a concave curvature, said deflection means and the moving fiber material web defining an air cushion therebetween; and a finalized dosing free let application unit for said direct application of the coating medium, said application unit being associated with a contactlessly guided section of the side of the material web, said application unit being disposed one of immediately before said deflection means relative to a direction of web travel and opposite said guiding surface of said deflection means.

13. An apparatus according to claim 12 application means arranged directly in front of the deflection wherein said application unit is disposed immediately before said deflection means relative to a direction of web travel, wherein the guiding surface of the deflection means is convexly curved and the side of the moving material web previously provided with the coating medium faces said guiding surface in passing the guiding surface.

14. The apparatus according to claim 12, wherein the guiding surface of the deflection means is concavely curved and the side of the moving material web to be provided with the coating medium faces away from said guiding surface in passing the guiding surface.

15. The apparatus according to claim 12, wherein a rotary guiding surface is provided.

16. The apparatus according to claims 12, wherein a stationary guiding surface is provided.

17. The apparatus according to claim 12, further comprising at least one means for blowing air into said air cushion.

18. The apparatus according to claim 17, further comprising at least one air nozzle before the deflection means relative to a direction of web travel.

19. The apparatus according to claim 17, wherein the guiding surface of the deflection means includes one of air nozzles and air openings.

20. The apparatus according to claim 12, further comprising a second guiding surface opposite and substantially parallel to the first guiding surface, the moving material web being guided between the two guiding surfaces.

21. The apparatus according to claim 12, further comprising at least one means for contactless drying associated with the deflection means.

22. The apparatus according to claim 21 having a means for blowing in air, wherein the means for blowing in air is operable at least partially with warm air.

23. The apparatus according to claim 12, further comprising at least one means for contactless drying disposed after the deflection means relative to a direction of web travel.

24. The apparatus according to claim 23, having a means for blowing in air, wherein the means for blowing in air is operable at least partially with warm air.

25. The apparatus according to claim 12, further comprising at least one means for applying steam onto the applied medium during the deflection.

26. The apparatus according to claim 12, further comprising at least one subpressure generating means for applying a subpressure onto a side of the material web facing away from the guiding surface.

27. The apparatus according to claim 26, wherein the subpressure generating means is arranged at a distance from the side of the material web facing away from the contactlessly guided section.

28. The apparatus according to claim 26, wherein at least one control and/or regulating means associated with the subpressure generating means is provided to set and/or regulate the subpressure locally differently and/or uniformly across substantially the entire width of the material web.

29. The apparatus according to claim 12, further comprising at least one support surface is arranged respectively before and after the contactless deflection means relative to a direction of web travel on a side of the material web facing away from the guiding surface.

30. The apparatus according to claim 29, wherein the support surfaces respectively arranged before and after the contactless deflection means oppose each other and are arranged with a spacing (W) therebetween.

31. The apparatus according to claim 29, wherein the concave curvature has a radius of curvature (R) which corresponds to essentially half the spacing (W) between the two support surfaces: ($R=W/2$).

32. The apparatus according to claim 12, wherein a switch-off means associated with the contactless deflection means is provided for selectively ending the contactless deflection of the material web after a run-in or start-up phase of the material web.

* * * * *

UNITED STATES PATENT AND TRADEMARK OFFICE

CERTIFICATE OF CORRECTION

PATENT NO. : 5,922,407

DATED : July 13, 1999

INVENTOR(S) : Herald Hess, et al.

It is certified that error appears in the above-identified patent and that said Letters Patent is hereby corrected as shown below:

COLUMN 17

Line 1, claim 12, delete "let" and substitute --jet-- therefor.

Signed and Sealed this

Sixth Day of February, 2001

*Attest:*

*Attesting Officer*

Q. TODD DICKINSON

*Director of Patents and Trademarks*